US010302303B2

(12) United States Patent
Chau

(10) Patent No.: US 10,302,303 B2
(45) Date of Patent: May 28, 2019

(54) CIGARETTE LIGHTER FOR SAFELY MOVING THROUGH DANGEROUS AREAS AND METHOD OF USE

(71) Applicant: Wai Kin Chau, Freehold, NJ (US)

(72) Inventor: Wai Kin Chau, Freehold, NJ (US)

( * ) Notice: Subject to any disclaimer, the term of this patent is extended or adjusted under 35 U.S.C. 154(b) by 217 days.

(21) Appl. No.: 15/585,438

(22) Filed: May 3, 2017

(65) Prior Publication Data

US 2018/0252408 A1 Sep. 6, 2018

Related U.S. Application Data

(60) Provisional application No. 62/600,958, filed on Mar. 6, 2017.

(51) Int. Cl.

| | |
|---|---|
| ***F23Q 2/167*** | (2006.01) |
| ***F23Q 2/28*** | (2006.01) |
| ***F23Q 2/173*** | (2006.01) |

(52) U.S. Cl.

CPC ..... *F23Q 2/167* (2013.01); *F23Q 2/173* (2013.01); *F23Q 2/28* (2013.01); *F23Q 2/285* (2013.01)

(58) Field of Classification Search

CPC ..... F23Q 1/00; F23Q 2/167
USPC ..... 431/136, 130, 142
See application file for complete search history.

(56) References Cited

U.S. PATENT DOCUMENTS

| | | | | |
|---|---|---|---|---|
| 2,692,491 | A * | 10/1954 | Hepburn | F23Q 2/02 431/130 |
| 2,710,533 | A | 6/1955 | Fischer | |
| 3,414,364 | A | 12/1968 | Bert | |
| 4,330,954 | A | 5/1982 | Lonsmin | |
| 5,460,520 | A | 10/1995 | Lin | |
| 5,531,591 | A | 7/1996 | Yamazaki | |
| 5,740,905 | A | 4/1998 | Kilfoy | |
| 6,257,872 | B1 | 7/2001 | Williams | |
| 6,431,853 | B1 | 8/2002 | Sher | |
| 6,443,727 | B1 | 9/2002 | Huang | |
| 6,478,575 | B2 | 11/2002 | Sher | |
| 6,726,470 | B1 | 4/2004 | Meister | |
| 6,733,277 | B2 | 5/2004 | Huang | |
| 6,939,128 | B2 | 9/2005 | Suzuki | |
| 6,945,771 | B2 * | 9/2005 | Xie | F23Q 2/42 431/142 |
| 7,815,432 | B2 | 10/2010 | Smith | |
| 2008/0044784 | A1 | 2/2008 | Park | |
| 2015/0257451 | A1 * | 9/2015 | Brannon | A24F 47/008 131/328 |
| 2016/0052700 | A1 | 2/2016 | Hearn | |

FOREIGN PATENT DOCUMENTS

| | | |
|---|---|---|
| CN | 201718464 U | 1/2011 |

* cited by examiner

*Primary Examiner* — Avinash A Savani
(74) *Attorney, Agent, or Firm* — Charles E. Baxley

(57) ABSTRACT

A cigarette lighter of the embodiments of the present invention that safely moves through dangerous areas and method of use. The cigarette lighter includes a lower section, an upper section, and a fuel flow controller. The upper section is replaceably attached to the lower section. The fuel flow controller interfaces with the lower section and the upper section and controls a flow of a fuel from the lower section where stored to the upper section where ignited.

43 Claims, 10 Drawing Sheets

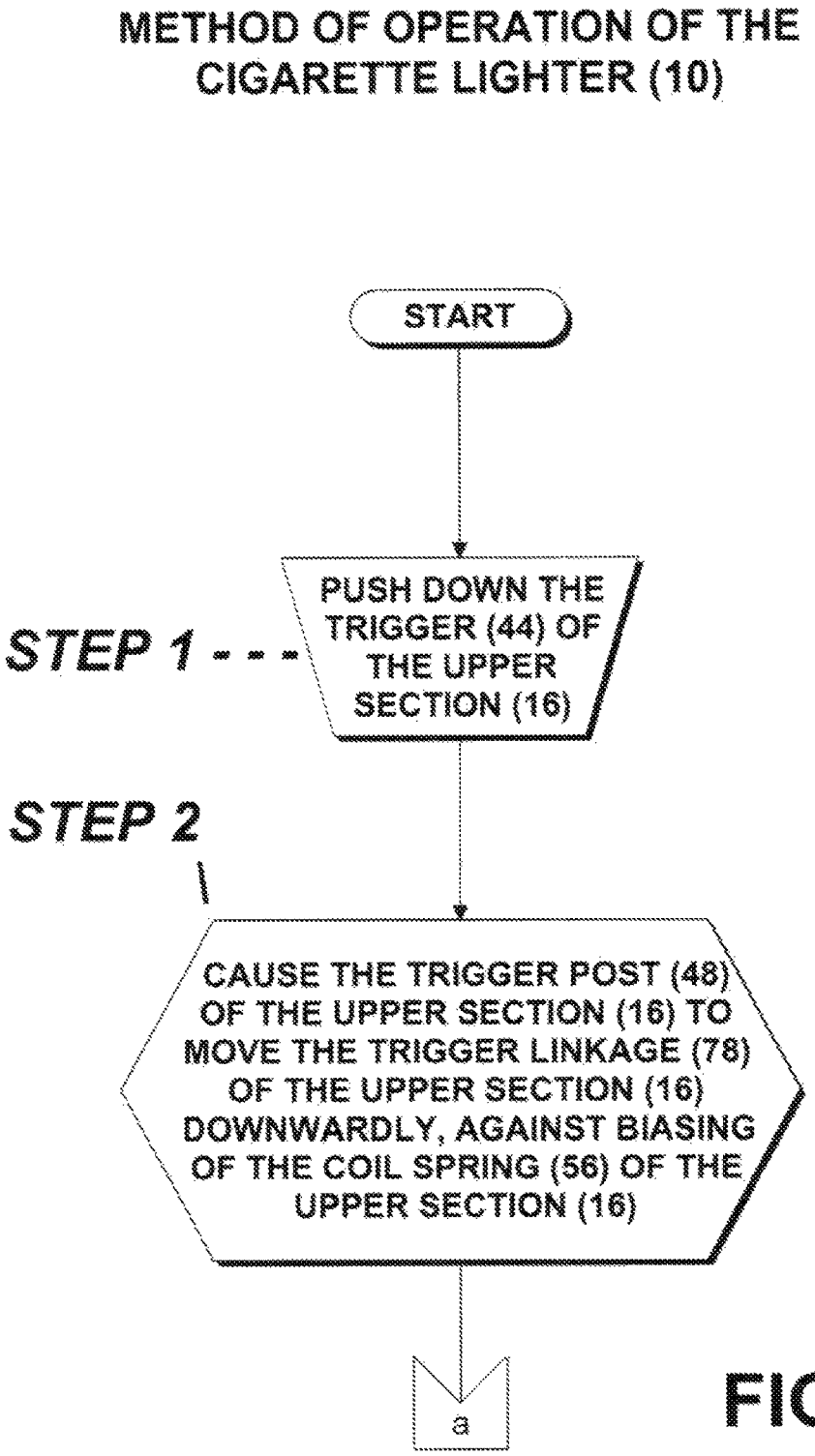
FIG 6-A

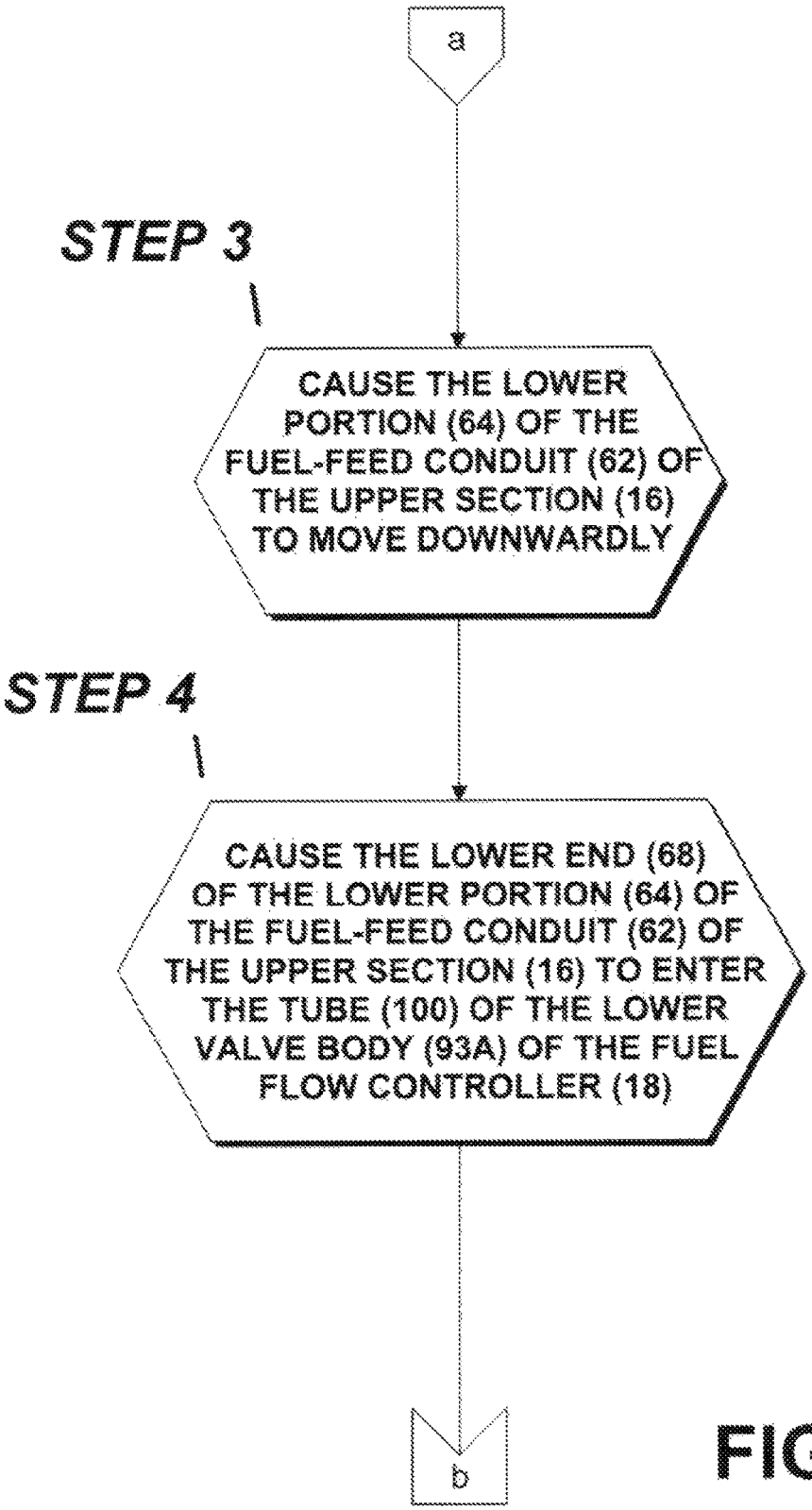
FIG 6-B

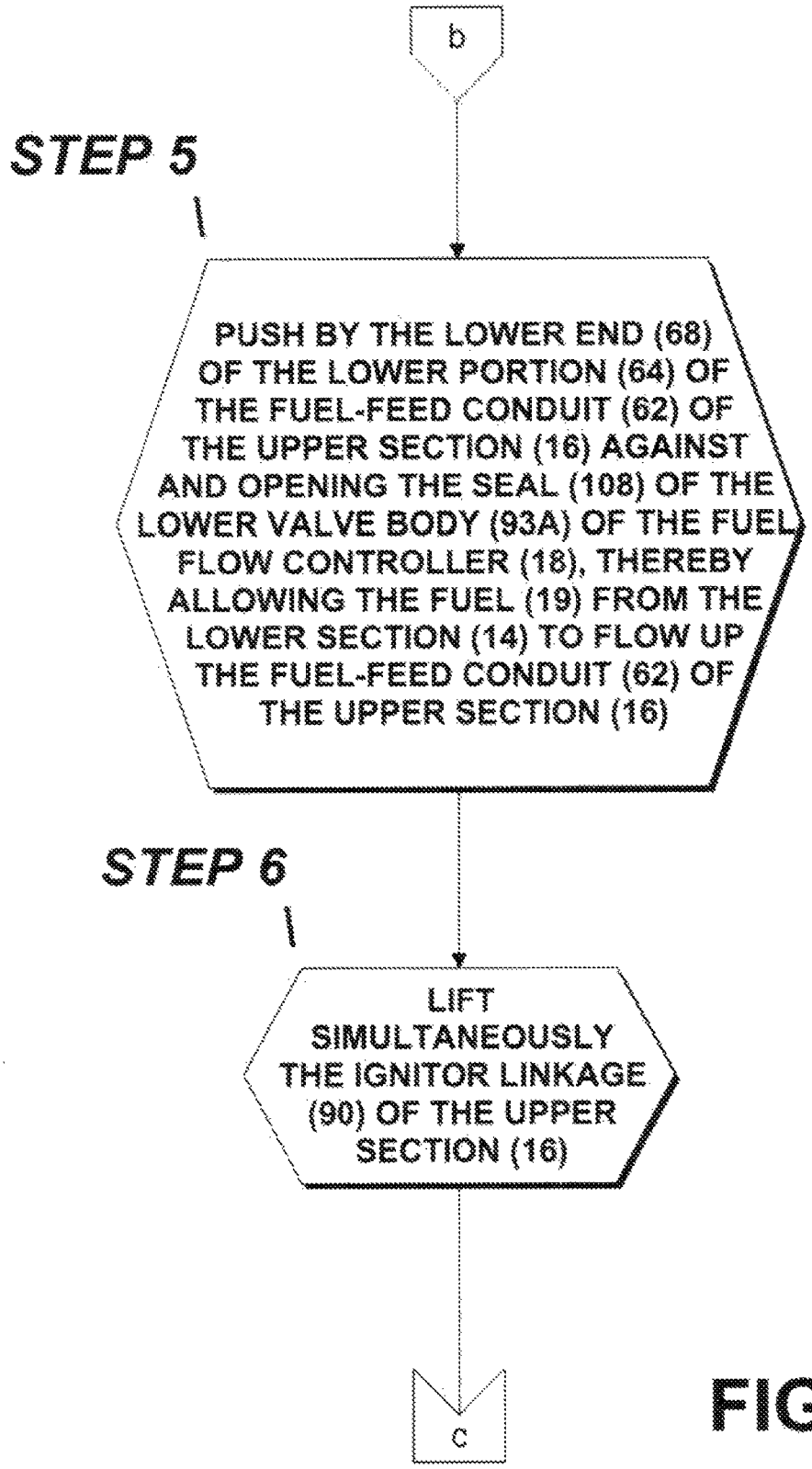
FIG 6-C

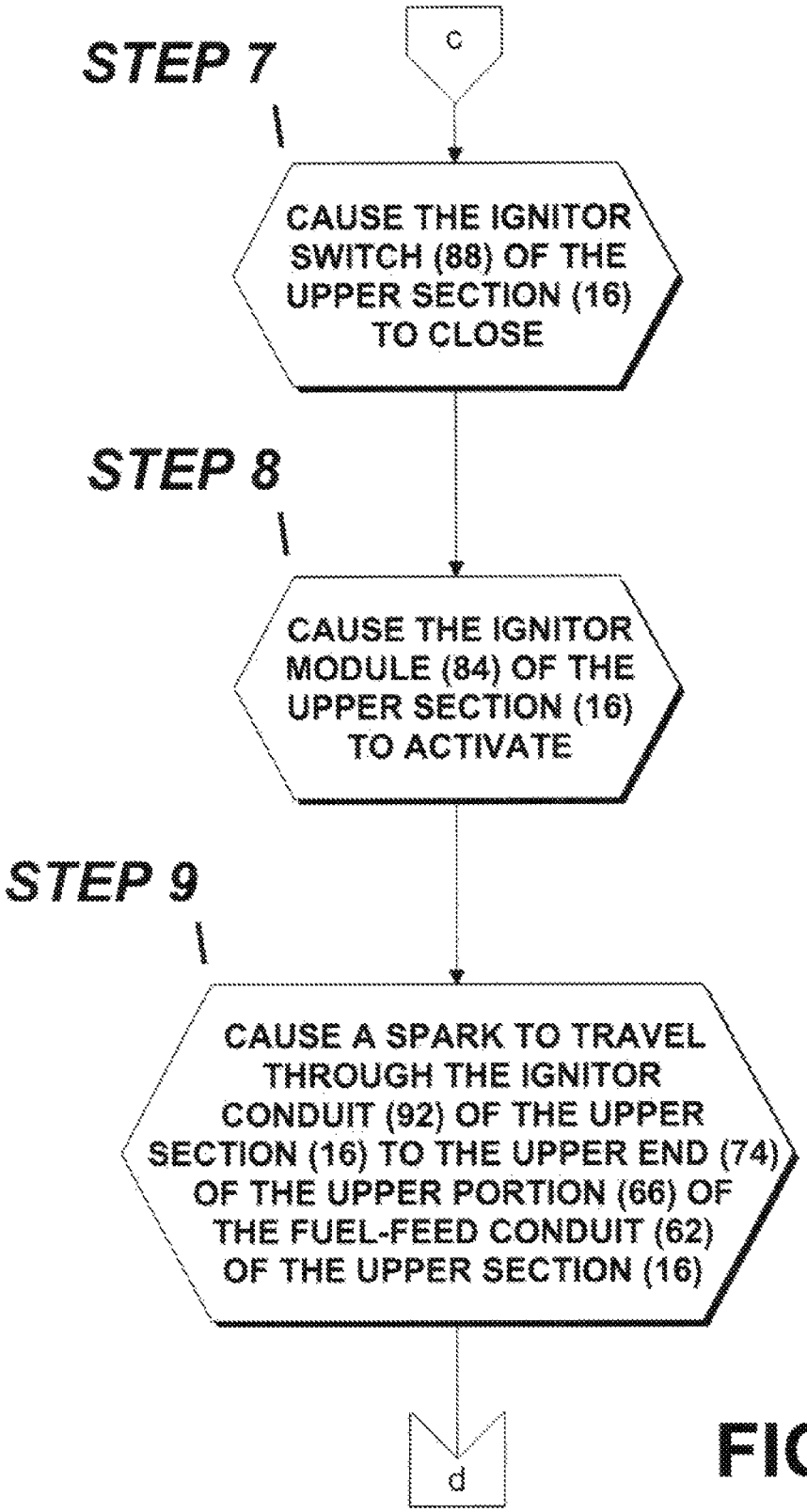
FIG 6-D

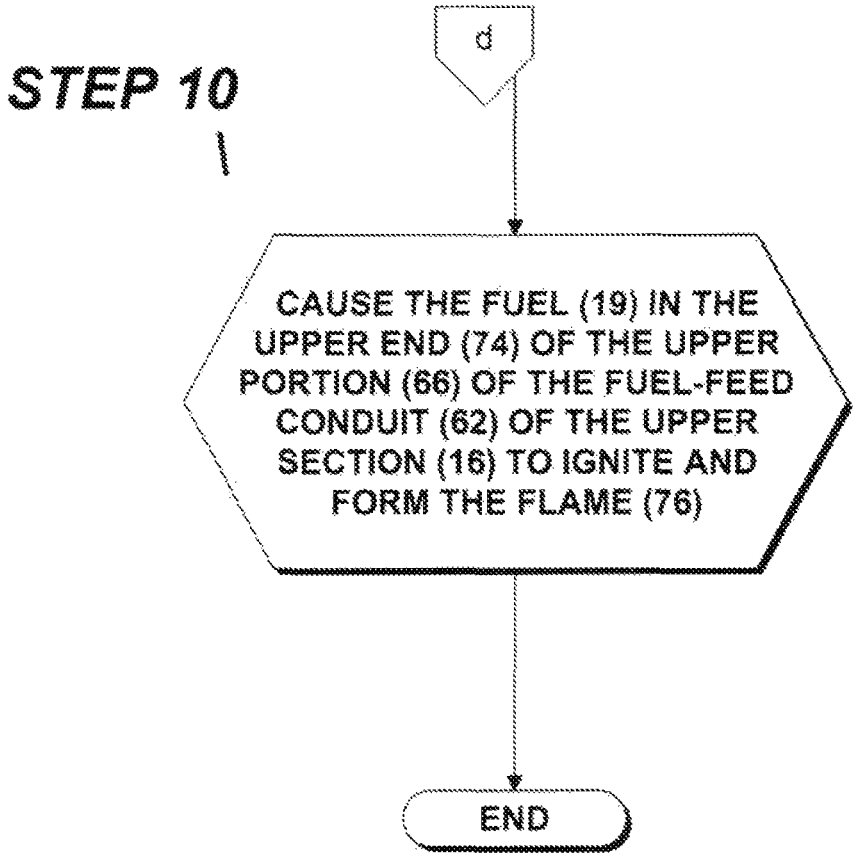
FIG 6-E

CIGARETTE LIGHTER FOR SAFELY MOVING THROUGH DANGEROUS AREAS AND METHOD OF USE

CROSS REFERENCE TO RELATED APPLICATIONS

The instant non-provisional patent application claims priority from provisional patent application No. 62/600,958, filed on Mar. 6, 2017, by Wai Kin Chau, for CIGARETTE LIGHTER WITH DETACHABLE FUEL, and incorporated herein in its entirety by reference thereto.

BACKGROUND OF THE INVENTION

Field of the Invention

The embodiments of the present invention relate to a cigarette lighter, and more particularly, the embodiments of the present invention relate to a cigarette lighter for safely moving through dangerous areas and method of use.

Description Of The Prior Art

Liquid fuel burning cigarette lighters generally include reservoirs within the lighter housings to contain the fuel and prevent inadvertent leaking. Numerous types of mechanisms and methods are known to release the fuel from the reservoirs in a controlled manner and to ignite the fuel for lighting a cigarette, cigar, or smoking pipe, however, there exists a need for removing the fuel cartridge from the lighter safely.

Numerous innovations for cigarette lighter usable devices have been provided in the prior art, which will be described below in chronological order to show advancement in the art, and which are incorporated herein in their entirety by reference thereto. Even though these innovations may be suitable for the specific individual purposes to which they address, nevertheless, they differ from the embodiments of the present invention.

U.S. Pat. No. 2,710,533 to Fischer et al

U.S. Pat. No. 2,710,533—issued to Fischer et al. on Jun. 14, 1955 in U.S. class 67 and subclass 7.1—teaches a ignition lighter mechanism that can be attached to a cartridge containing a liquified fuel under pressure, such as, butane, propane, and similar fuels that are adapted to turn into a gas upon being released into the atmosphere from the reservoir or container. A feature resides in the combination of a cartridge that carries a supply of liquified fuel, and the neck of which, is threaded so as to receive the lighter unit that includes a fuel release valve that permits the fuel from the cartridge to leak slowly through the same, a snufier cap, and a pyrophoric flint, and abrading wheel to direct a spark over the nozzle of the lighter unit. This combination of elements including mainly the cartridge holding a supply of compressed fuel for the flame of the lighter and the lighter unit provide the essential elements of the combination that produce a lighter, either of the pocket type or the desk type.

U.S. Pat. No. 4,330,954 to Lonsmin

U.S. Pat. No. 4,330,954—issued to Lonsmin on May 25, 1982 in U.S. class 40 and subclass 486—teaches a cigarette lighter cover that is a novelty sleeve for the cigarette lighter, and which has a tubular body portion with a hollow interior space sized to receive the body of the cigarette lighter of conventional design. One end of the body portion is closed off to form a bottom end of the sleeve. The other end of the body portion is open to receive the cigarette lighter. An image-presenting assembly is situated on one side of the sleeve and includes a filmstrip. Opaque portions of the filmstrip have a desired color to provide a portion of an image and a translucent portion has the remaining portion of the image that is caused to appear and disappear. A dark background is situated behind the translucent portion of the filmstrip and a light colored shield is positioned behind the filmstrip, between the filmstrip and the dark background. The shield has a handle for moving the shield to, and from, a position behind the portion of the image defined by the translucent portion of the filmstrip, thereby to cause it to appear when the shield is moved therebehind.

U.S. Pat. No. 3,414,364 to Bert

U.S. Pat. No. 3,414,364—issued to Bert on Dec. 3, 1968 in U.S. class 431 and subclass 143—teaches a pyrophoric cigarette lighter having a disposable fuel container which itself constitutes the main body of the lighter, complemental securing apparatus forming part of the container and cooperating with corresponding complemental securing apparatus carried by a separate igniting mechanism and a separate pressure reducer and burner unit for operatively and detachably affixing the unit and the mechanism to the disposable container. Numerous gas lighters having a disposable refill cartridge allow the user to change not only the cartridge or container, but also one of the components of the lighter. These components, however, form complex assemblies and consequently expensive units. Generally, the pressure reducer and burner unit is either an integral part of the igniting mechanism or is permanently attached to the disposable container, while the igniting mechanism forms a permanent unit with the body of the gas lighter and with the flint-carrying tube and the like.

U.S. Pat. No. 5,460,520 to Lin

U.S. Pat. No. 5,460,520—issued to Lin on Oct. 24, 1995 in U.S. class 431 and subclass 255—teaches a gas torch including a container that holds a disposable gas lighter, and a casing detachably connected to the container, at a top thereof to hold an electric ignition device. The casing has a horizontal partition wall to hold a gas flow guide and a flame nozzle. A trigger is turned about a pivot inside the casing and is controlled to depress the gas lever of the disposable gas lighter and the control lever of the electronic ignition device causing a flame produced at the flame nozzle.

U.S. Pat. No. 5,531,591 to Yamazaki

U.S. Pat. No. 5,531,591—issued to Yamazaki on Jul. 2, 1996 in U.S. class 431 and subclass 153—teaches a safety device for use in a gas lighter. An actuating member provided on top of a lighter body is supported in a pivotal fashion by a leg downwardly extending therefrom. The leg is also provided with a lock member. A circular-arc-shaped guide groove and a recessed groove at the center-side end of the guide groove are formed along the upper end of one of the tank side surfaces. The lock member has a base portion that travels along a regulation groove in a restricted manner, a stopper that is connected to an upper part of the base portion and is engageable with the recessed groove, a finger grip that permits a lock release operation and causes the stopper fitted into the recessed groove to be engaged with the guide groove, and a spring member for urging the base portion toward the center of the lighter body and holding the lock member in a locked position and an unlocked position. The elements of the lock member are formed into one assembly. Fitting of the stopper into the recessed groove deters the pivotal movement of the actuating member. Disengagement of the stopper from the recessed groove permits pivotal movement of the actuating member, and the lock member is displaced to a lockable position upon coming into contact with the end face of the guide groove. The spring member is in a coiled shape, but may be formed into a U-shaped, V-shaped, or bow-shaped pattern.

U.S. Pat. No. 5,740,905 to Kilfoy

U.S. Pat. No. 5,740,905—issued to Kilfoy on Apr. 21, 1998 in U.S. class 206 and subclass 87—teaches a key ring attachable lighter holding shell with flexible holding flaps is a shell-shaped holder into which a reusable lighter or a disposable lighter may be inserted and held securely, yet can also be taken out and replaced again, and it may be attached to a key ring or key chain in order to help prevent a person from losing a lighter as long as the keys are not lost.

U.S. Pat. No. 6,257,872 to Williams

U.S. Pat. No. 6,257,872—issued to Williams on Jul. 10, 2001 in U.S. class 431 and subclass 253—teaches a decorative apparatus for removable attachment to a cigarette lighter. The body of which tapers upwardly and inwardly from its base to the top thereof. The apparatus includes a rigid band. The interior of which is smaller than the cross-sectional area of the lighter base, but larger than the cross-sectional area of the lighter top. One or more distinctive members may be affixed to the band for enhancing appearance and identification.

U.S. Pat. No. 6,431,853 to Sher

U.S. Pat. No. 6,431,853—issued to Sher on Aug. 13, 2002 in U.S. class 431 and subclass 153—teaches a cigarette lighter including a housing. An ignition apparatus is provided for the lighter. The ignition apparatus includes a member manually movable with respect to the housing. A lock between the manually moveable member and the housing, and release apparatus are manually operable to release the lock to allow the manually moveable member to move relative to the housing to allow or cause ignition of the lighter. The release apparatus requires manual movement to release the lock in a direction different to the direction of movement of the manually moveable member to allow or cause ignition.

U.S. Pat. No. 6,443,727 to Huang

U.S. Pat. No. 6,443,727—issued to Huang on Sep. 3, 2002 in U.S. class 431 and subclass 132—teaches a safety lighter that is locked in a non-operable condition with a safety latch operable with a rotatable gear device. The rotatable gear is located in a top surface of the lighter actuator and is coupled to a rack that moves linearly when the gear is rotated. The rack is extended into, or withdrawn from, the lighter housing to prevent or permit actuation of the lighter mechanism, respectfully. A lower portion of the rack has a sloped profile to permit the rack to be pushed upward by the lighter housing when the actuation device is returned to a normal locked position. In the normal locked position, the rack is driven into the lighter housing by a spring located in the actuator. The actuator mechanism is unlocked by rotating the gear in a direction opposite to that of the rotational direction for operating the actuator. The location of the gear on the top surface of the actuator permits the actuator to be unlocked and operated.

U.S. Pat. No. 6,478,575 to Sher

U.S. Pat. No. 6,478,575—issued to Sher on Nov. 12, 2002 in U.S. class 43 land subclass 153—teaches a lighter that has a housing, a gas reservoir in the housing, and an ignition apparatus. The ignition apparatus includes a first manually moveable member and a second independently operable and manually moveable member so that when the first member is operated gas is supplied from the gas reservoir and when the second member is operated the ignition apparatus operates, so that both the first manually moveable member and the second manually moveable member must be operated to cause the lighter to ignite. The two manually moveable members may include a cap to the housing and a button moveable in a channel in the cap.

U.S. Pat. No. 6,726,470 to Meister

U.S. Pat. No. 6,726,470—issued to Meister on Apr. 27, 2004 in U.S. class 431 and subclass 154—teaches a windproof lighter having an inside unit and an exterior case. The inside unit has an interior chamber, a wick, a flint, a flint position apparatus positioned in the interior chamber, a flint wheel, and a chimney. The lighter has a disposable fuel cell containing lighter fuel. The fuel cell is designed to fit within the interior chamber and to not interfere with the flint position apparatus. When the container is to be used in a windproof lighter, it has an opening that receives the wick. The wick extends into the interior chamber and has a component that is larger than the opening so that when the container is properly positioned within the interior chamber, the component secures the container in position and prevents accidental spillage of the lighter fuel.

U.S. Pat. No. 6,733,277 to Huang

U.S. Pat. No. 6,733,277—issued to Huang on May 11, 2004 in U.S. class 431 and subclass 153—teaches a locking lever for a lighter actuation mechanism that prevents the actuator from operating when in a locked position. Operation of the lever causes a portion of the lever to be withdrawn from a housing portion of the lighter and permits the actuator to be moved and operated. The lever mechanism is spring-loaded so that the end of the lever normally extends into the lighter housing in a locked position. A top portion of the lever is flattened and curved to prevent intuitive operation while permitting easy disengaging of the locking mechanism. An end portion of the locking lever has a sloped profile to move the lever in an upward direction when the actuator device is returned to a normal position, after operating the lighter. When the lighter actuator returns to the normal position, the spring-loaded lever again extends into the housing of the lighter to prevent accidental operation. The locking lever is accessible through a top surface of the lighter actuator to permit the lighter to be unlocked and actuated with a simple motion.

U.S. Pat. No. 6,939,128 to Suzuki et al

U.S. Pat. No. 6,939,128—issued to Suzuki et al. on Sep. 6, 2005 in U.S. class 431 and subclass 130—teaches an ignition operation mechanism for slide type lighters that is capable of preventing accidental ignition or ignition due to erroneous use or the like while maintaining good operability. Pivots for an operating cap are made substantially circular in cross section and so sized as to form a vertically movable clearance as they are locked to a support section in the lighter main body. The pivots for the operating cap are normally urged to be positioned in the upper region of the interior of a support section by the spring force of a return spring for a piezoelectric mechanism. The operating cap is slid until a lever member, strikes the lighter main body, and no longer moves in the slide direction, from which state, the operating cap is pressed downward, whereby the pivots move downward within the support section, whereupon pressing levers reach the operation stroke that overcomes the piezoelectric mechanism producing a discharge voltage to enable ignition.

United States Patent Application Publication Number 2008/0044784 to Park

United States Patent Application Publication Number 2008/0044784—published to Park on Feb. 21, 2008 in U.S. class 431 and subclass 344—teaches two basic components, a housing and a fuel cartridge. The housing may include multiple pieces. The fuel cartridge is easy to remove from the housing without the use of any tools. Thus, an empty fuel cartridge can quickly be replaced with a full one by the user. Replacing the fuel cartridge, rather than refilling it, prevents the user from coming into contact with lighter fuel. A worn or damaged housing may be removed from the lighter by the user and replaced with a new housing. All or part of the housing may also be replaced with a housing having a different outward appearance. A user can thus change the appearance of his or her lighter by changing housings, rather than having to purchase multiple lighters. The housing may include surface features, such as, bosses, ribs, and/or tensioning springs to tighten a fit of the housing and prevent spontaneous separation. The surface features may also protect the appearance of the housing.

U.S. Pat. No. 7,815,432 to Smith

U.S. Pat. No. 7,815,432—issued to Smith on Oct. 19, 2010 in U.S. class 431 and subclass 143—teaches cigarette lighter having a removable fuel cartridge with a reservoir for holding flammable liquid fuel, a valve for controlling the flow of fuel into and from the reservoir, an ignition actuator for causing ignition of the fuel, a nozzle for causing the ignited fuel to form a lighting flame, and a valve actuator that cooperates with the ignition actuator to open the valve as the ignition actuator is actuated. The reservoir has a transparent portion that is aligned with a window in the lighter housing to allow external observation of the fuel level in the reservoir. The transparent portion includes indicia for gauging the amount of fuel. The indicia is structurally contoured to provide an apparatus for engaging the reservoir to remove the fuel cartridge from the lighter.

Chinese Patent Number CN 201718464 U to Guo

Chinese Patent Number CN 201718464 U—issued to Guo on Jan. 26, 2011 in International class A24F15 and subclass 18—teaches a cigarette case with a disposable lighter, which includes a cigarette case body. A cavity for containing the disposable lighter is arranged on one side of the case body. Further included is a lighter cover arranged outside the cavity body. The lighter cover is in a close sliding fit with the case body. The disposable lighter requires no gas charging.

United States Patent Application Publication Number 2016/0052700 to Hearn et al

United States Patent Application Publication Number 2016/0052700—published to Hearn et al. on Feb. 25, 2016—teaches a pressurized refill canister containing a composition including a propellant. The canister has an outlet valve having a stem biased to a closed position by a first resilient member. The stem has a maximum outer diameter of greater than 3 mm. At the outlet end of the stem, at least part of the wall of the stem extends inwardly from the outside diameter for at least 50% of the radius.

It is apparent that numerous innovations for cigarette lighter usable devices have been provided in the prior art, which are adapted to be used. Furthermore, even though these innovations may be suitable for the specific individual purposes to which they address, nevertheless, they would not be suitable for the purposes of the embodiments of the present invention as heretofore described.

SUMMARY OF THE INVENTION

Thus, an object of the embodiments of the present invention is to provide a cigarette lighter for safely moving through dangerous areas, which avoids the disadvantages of the prior art.

Briefly stated, another object of the embodiments of the present invention is to provide a cigarette lighter of the embodiments of the present invention that safely moves through dangerous areas and method use. The cigarette lighter includes a lower section, an upper section, and a fuel flow controller. The upper section is replaceably attached to the lower section. The fuel flow controller interfaces with the lower section and the upper section and controls a flow of a fuel from the lower section where stored to the upper section where ignited.

The novel features considered characteristic of the embodiments of the present invention are set forth in the appended claims. The embodiments of the present invention themselves, however, both as to their construction and to their method of operation, together with additional objects and advantages thereof will be best understood from the following description of the embodiments of the present invention when read and understood in connection with the accompanying figures of the drawing.

BRIEF DESCRIPTION OF THE FIGURES OF THE DRAWING

The figures of the drawing are briefly described as follows:

FIGS. 6A-6E are a diagrammatic flowchart of the method of operation of the cigarette lighter of the embodiments of the present invention.

LIST OF REFERENCE NUMERALS UTILIZED IN THE FIGURES OF THE DRAWING

Introductory

Figure 1:
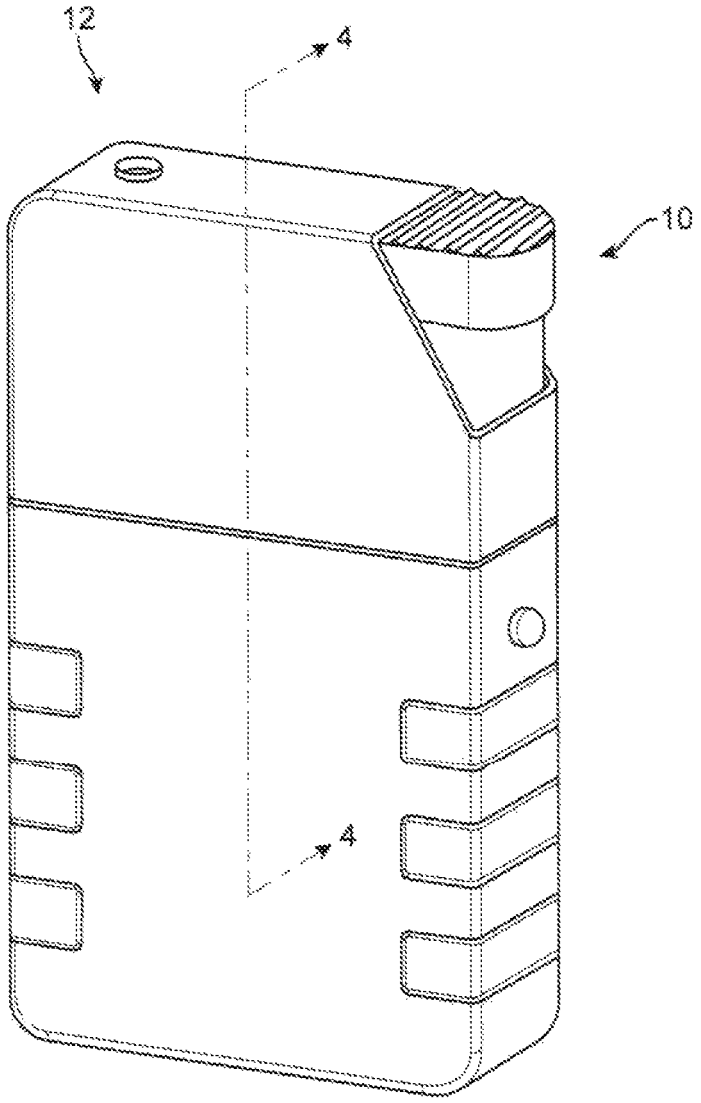
FIG. 1 is a diagrammatic perspective view of the cigarette lighter of the embodiments of the present invention safely moving through dangerous areas.

10 cigarette lighter of embodiments of present invention for safely moving through dangerous areas 12
12 dangerous areas

Overall Configuration of Cigarette Lighter 10

14 lower section
16 upper section
18 fuel flow controller for controlling flow of fuel 19 from lower section 14 for storage to upper section 16 for ignition
19 fuel

Specific Configuration of Lower Section 14

20 top of lower section 14
22 side of lower section 14
24 axial male flange of lower section 14
26 replaceable canister of lower section 14
28 reservoir contained within replaceable canister 26 of lower section 14 for storing fuel 19 therein
30 spring-loaded ball-release of lower section 14

Specific Configuration of Upper Section 16

31 top of upper section 16
32 bottom of upper section 16
34 initial working side of upper section 16
36 terminal worked side of upper section 16
38 corner of upper section 16
40 portion of initial working side 34 of upper section 16 after corner 38 of upper section 16 is removed
42 through bore in portion 40 of initial working side 34 of upper section 16
44 trigger of upper section 16
46 scaffolding of upper section 16
47*h* horizontal portion of scaffolding 46 of upper section 16
47*v* vertical portion of scaffolding 46 of upper section 16
48 trigger post of upper section 16
50 upper end of trigger post 48 of upper section 16
52 lower end of trigger post 48 of upper section 16
54 trigger connecting rod of upper section 16
56 coil spring of upper section 16
58 upper portion of trigger post 48 of upper section 16
60 spring seat of horizontal portion 47*h* of scaffolding 46 of upper section 16
62 fuel-feed conduit of upper section 16
64 lower portion of fuel-feed conduit 62 of upper section 16
66 upper portion of fuel-feed conduit 62 of upper section 16
68 lower end of lower portion 64 of fuel-feed conduit 62 of upper section 16
70 upper end of lower portion 64 of fuel-feed conduit 62 of upper section 16
72 lower end of upper portion 66 of fuel-feed conduit 62 of upper section 16
74 upper end of upper portion 66 of fuel-feed conduit 62 of upper section 16
75 reduced portion of lower end 68 of lower portion 64 of fuel-feed conduit 62 of upper section 16
76 output hole for flame of upper end 74 of upper portion 66 of fuel-feed conduit 62 of upper section 16 for igniting cigarette
78 trigger linkage of upper section 16
80 initial working end of trigger linkage 78 of upper section 16
82 terminal worked end of trigger linkage 78 of upper section 16
84 ignitor module of upper section 16
86 ignitor switch enclosure of upper section 16 for safety
88 ignitor switch of upper section 16
90 ignitor linkage of upper section 16
92 ignitor conduit of upper section 16 for ignition

Specific Configuration of Fuel Flow Controller 18

93 upper valve body of fuel flow controller 18
93*a* lower valve body of fuel flow controller 18

Specific Configuration of Upper Valve Body 93 of Fuel Flow Controller 18

94 upper flange of fuel flow controller 18
96 O-ring of fuel flow controller 18 for preventing leakage of fuel 19 as lower portion 64 of fuel-feed conduit 62 of upper section 16 passes into lower valve body 93*a* of fuel flow controller 18

The Lower Valve Body 93*a* of Fuel Flow Controller 18

100 tube of lower valve body 93*a* of fuel flow controller 18
102 upper end of tube 100 of lower valve body 93*a* of fuel flow controller 18
104 lower end of tube 100 of lower valve body 93*a* of fuel flow controller 18
106 lower flange of lower valve body 93*a* of fuel flow controller 18
108 seal of lower valve body 93*a* of fuel flow controller 18
110 coil spring of lower valve body 93*a* of fuel flow controller 18

DETAILED DESCRIPTION OF THE PREFERRED EMBODIMENTS

Introductory

Figure 2:
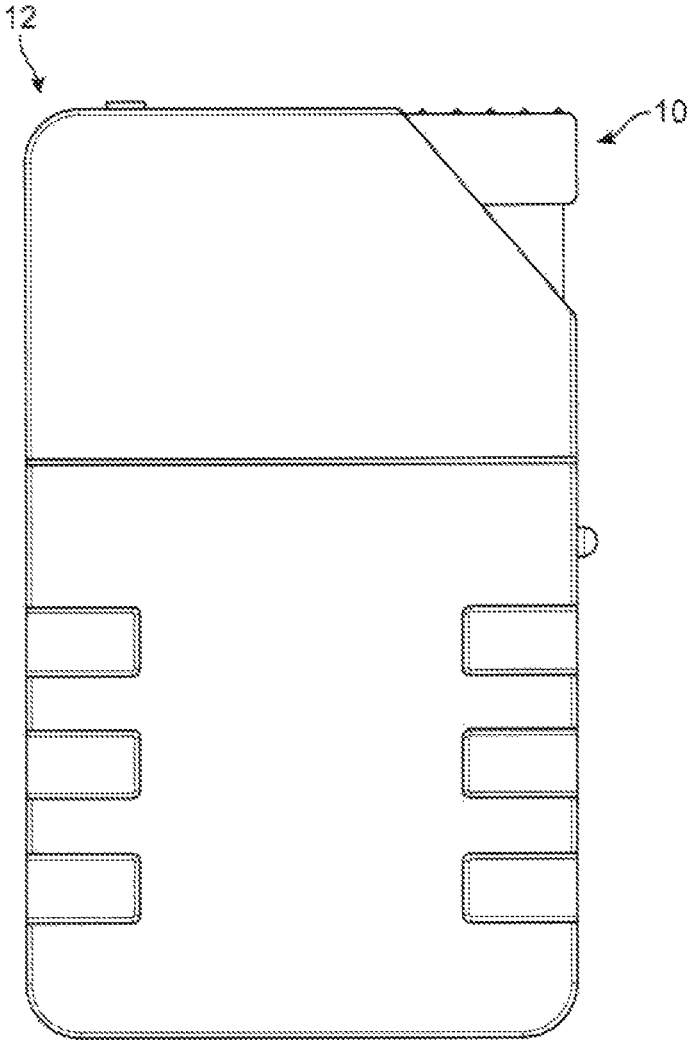
FIG. 2 is a diagrammatic side elevational view of the cigarette lighter of the embodiments of the present invention safely moving through dangerous areas.

Referring now to the figures, in which like numerals indicate like parts, and particularly to FIGS. 1 and 2, the cigarette lighter of the embodiments of the present invention is shown generally at 10 for safely moving through dangerous areas 12.

Overall Configuration of the Cigarette Lighter 10

Figure 3:
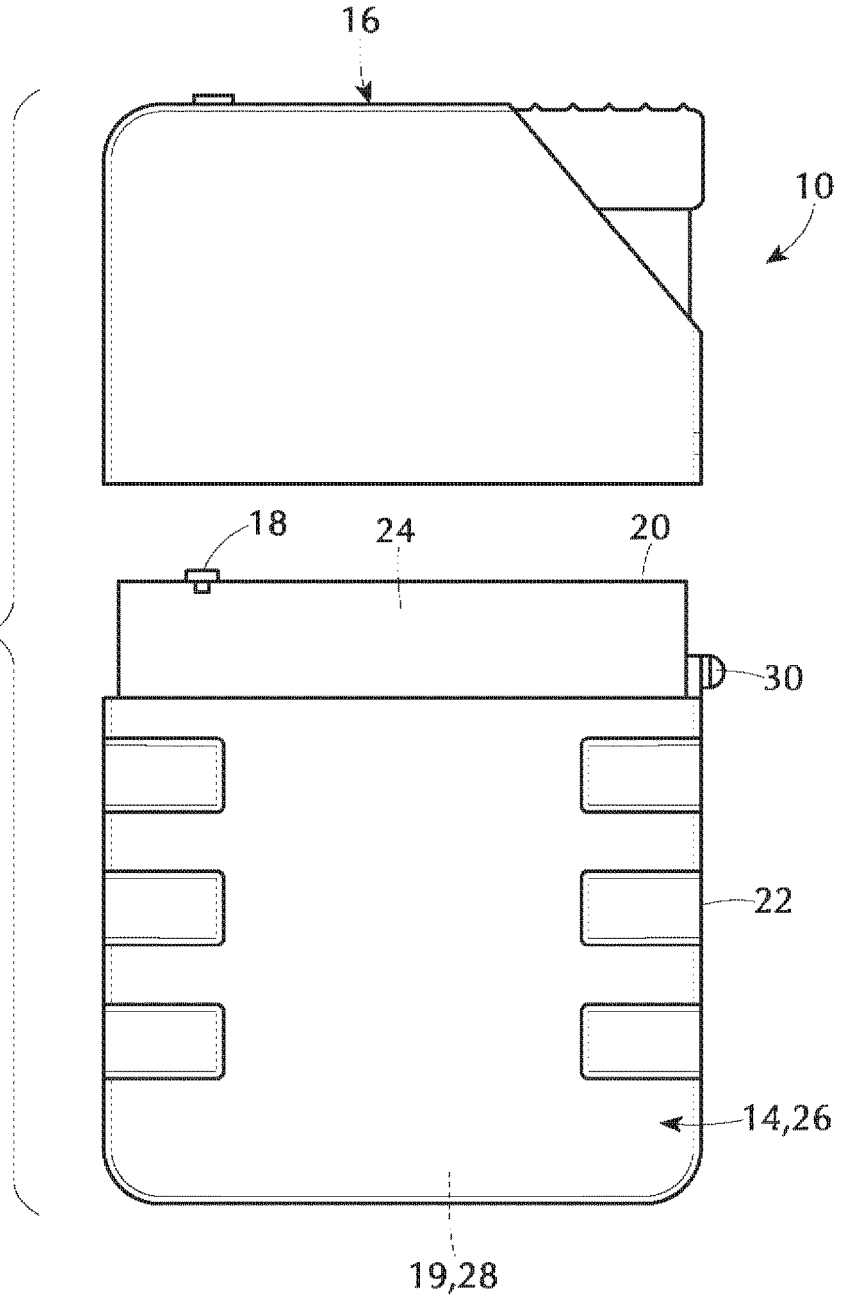
FIG. 3 is an enlarged and partially exploded diagrammatic side elevational view of the cigarette lighter shown in FIGS. 1 and 2.

The overall configuration of the cigarette lighter 10 can best be seen in FIG. 3, and as such, will be discussed with reference thereto.

The cigarette lighter 10 comprises a lower section 14, an upper section 16, and a fuel flow controller 18. The upper section 16 is replaceably attached to the lower section 14. The fuel flow controller 18 interfaces with the lower section 14 and the upper section 16 and controls a flow of a fuel 19 from the lower section 14 where stored to the upper section 16 where ignited.

Specific Configuration of the Lower Section 14

The specific configuration of the lower section 14 can best be seen in FIG. 3, and as such, will be discussed with reference thereto.

The lower section 14 is generally rectangular-shaped and hollow, and has a top 20 and a side 22.

The top 20 of the lower section 14 is open to communicate with the upper section 16 while holding the fuel flow controller 18 in position, and is reduced laterally to form an axial male flange 24 therearound.

The lower section 14 is a replaceable canister 26 that contains a reservoir 28 for storing the fuel 19 therein.

The lower section 14 has a spring-loaded ball-release 30 that is biased outwardly, and is disposed on the axial male flange 24 of the top 20 of the lower section 14.

Specific Configuration of the Upper Section 16

Figure 4:
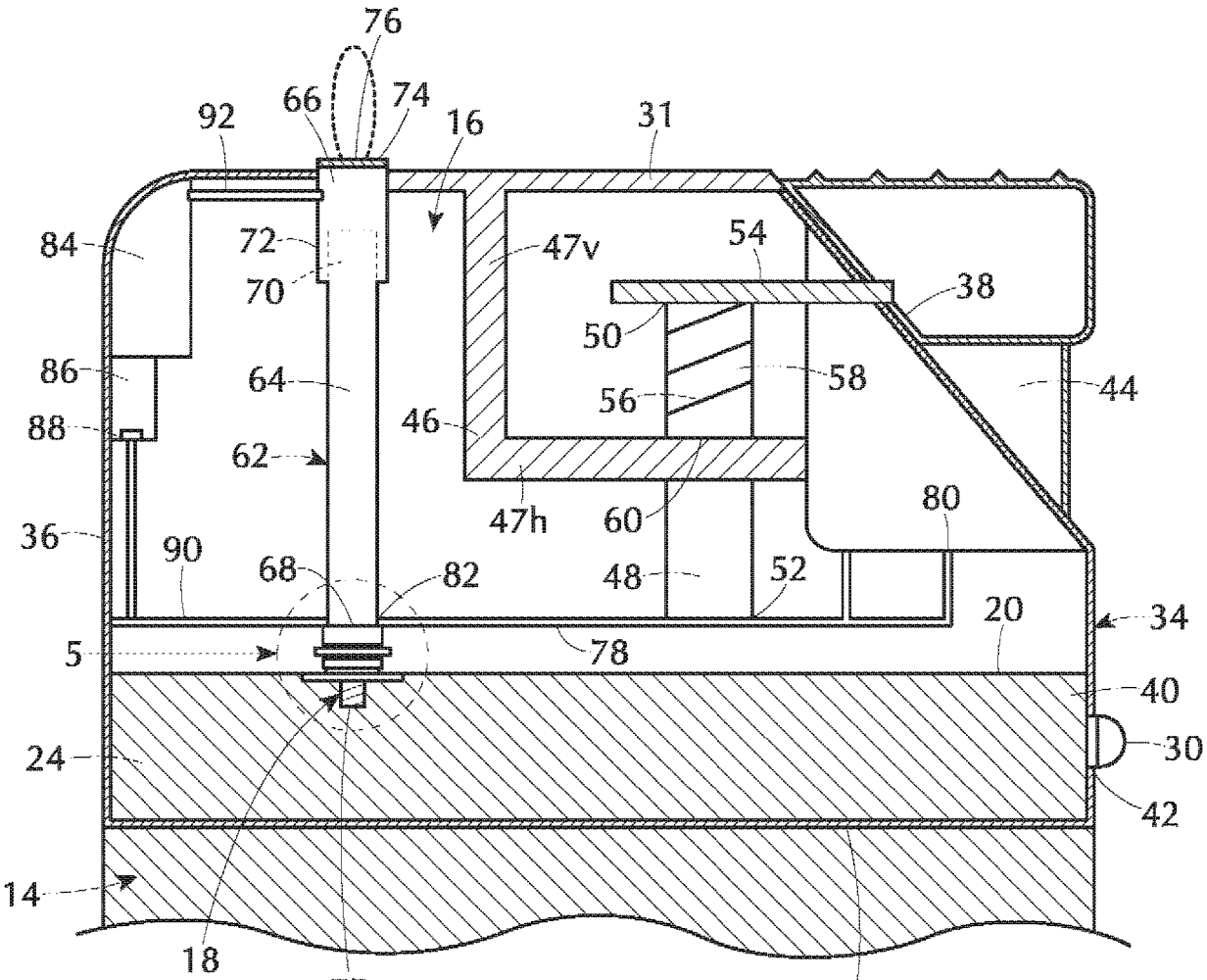
FIG. 4 is an enlarged diagrammatic cross sectional view taken along LINE 4-4 in FIG. 1.

The specific configuration of upper section 16 can best be seen in FIG. 4, and as such, will be discussed with reference thereto.

The upper section 16 is generally rectangular-shaped and hollow, and has a top 31, a bottom 32, an initial working side 34, a terminal worked side 36, and a corner 38 where the initial working side 34 of the upper section 16 meets the top 31 of the upper section 16.

The corner 38 of the upper section 16 is removed, leaving a portion 40 of the initial working side 34 of the upper section 16 in tact. The portion 40 of the initial working side 34 of the upper section 16 has a through bore therethrough 42.

The bottom 32 of the upper section 16 is open to communicate with the lower section 14, while selectively and frictionally receiving the axial male flange 24 of the lower section 14, and the through bore 42 of the portion 40 of the initial working side 34 of the upper section 16 selectively receives the spring-loaded ball-release 30 of the lower section 14.

The spring-loaded ball-release 30 of the lower section 14 is pushed in and out of the through bore 42 of the portion 40 of the initial working side 34 of the upper section 16 preventing spontaneous separation and the upper section 16 is then pulled up and off, thereby removing the upper section 16 from the lower section 14 and discarding the lower section 14 so that the upper portion can be moved safely through the dangerous areas 12.

The upper section 16 further has a trigger 44. The trigger 44 of the upper section 16 is movably mounted in the corner 38 of the upper section 16.

The upper section 14 contains scaffolding 46. The scaffolding 46 of the upper section 16 is fixedly attached within, and to, the upper section 16. The scaffolding 46 of the upper section is generally L-shaped, extends downwardly from the top 31 of the upper section 16 in a vertical portion 47*v*, and laterally to the corner 38 of the upper section 16 in an horizontal portion 47*h*.

The upper section 14 further contains a trigger post 48. The trigger post 48 of the upper section 16 is vertically oriented, moves vertically through the horizontal portion 47*h* of the scaffolding 46 of the upper section 16, and has an upper end 50 and a lower end 52.

The upper section 14 further contains a trigger connecting rod 54. The trigger connecting rod 54 of the upper section 16 is horizontally oriented and extends fixedly from, so as to move with, the upper end 50 of the trigger post 48 of the upper section 16 fixedly to, so as to move with, the trigger 44 of the upper section 16.

The upper section 14 further contains a coil spring 56. The coil spring 56 of the upper section 16 coils around an upper portion 58 of the trigger post 48 of the upper section 16. The upper portion 58 of the trigger post 48 of the upper section 16 extends from the trigger connecting rod 54 of the upper section 16 to a spring seat 60 of said horizontal portion 47*h* of the scaffolding 46, so as to normally bias the trigger 44 of the upper section 16 upward via the trigger connecting rod 54 of the upper section 16, so when the trigger 44 of the upper section 16 is pressed downwardly, the coil spring 56 of the upper section 16 compresses as the trigger post 48 of the upper section 16 moves downwardly, and when pressure is removed from the trigger 44 of the upper section 16, the coil spring 56 of the upper section 16 biases the trigger 44 of the upper section 16 back upwardly to normal.

The upper section 14 further contains a fuel-feed conduit 62. The fuel-feed conduit 62 of the upper section 16 is vertically oriented, hollow, is disposed parallel to, and inwardly of, the terminal worked side 36 of the upper portion 16, and includes a lower portion 64 and an upper portion 66.

The lower portion 64 of the fuel-feed conduit 62 of the upper section 16 has a lower end 68 and an upper end 70, while the upper portion 66 of the fuel-feed conduit 62 of the upper section 16 has a lower end 72 and an upper end 74.

The lower end 68 of the lower portion 64 of the fuel-feed conduit 62 of the upper section 16 has a reduced portion 75.

The upper end 74 of the upper portion 66 of the fuel-feed conduit 62 of the upper section 16 is vertically affixed to, and accessible via, the top 31 of the upper section 16, with the lower end 72 of the upper portion 66 of the fuel-feed conduit 62 of the upper section 16 and the upper end 74 of the upper portion 66 of the fuel-feed conduit 62 of the upper section 16 both being open.

The lower end 72 of the upper portion 66 of the fuel-feed conduit 62 of the upper section 16 telescopically receives the upper end 70 of the lower portion 64 of the fuel-feed conduit 62 of the upper section 16 so as to allow the lower portion 64 of the fuel-feed conduit 62 of the upper section 16 to slide up and down in the upper portion 66 of the fuel-feed conduit 62 of the upper section 16.

The upper end 74 of the upper portion 66 of the fuel-feed conduit 62 of the upper section 16 is an output hole 76 for a flame for igniting a cigarette.

The upper section 16 further contains a trigger linkage 78. The trigger linkage 78 of the upper section 16 is generally horizontally oriented and has an initial working end 80 and a terminal worked end 82. The initial working end 80 of the trigger linkage 78 of the upper section 16 is affixed to, depends from, and moves up and down with, the trigger 44 of the upper section 16.

The trigger linkage 78 of the upper section 16 extends continuously from, is affixed to, and moves up and down with, the lower end 52 of the trigger post 48 of the upper section 16.

The trigger linkage 78 of the upper section 16 extends continuously from the lower end 52 of the trigger post 48 of the upper section 16, with the terminal worked end 82 of the trigger linkage 78 of the upper section 16 affixed to the reduced portion 75 of the lower end 68 of the lower portion 64 of the fuel-feed conduit 62 of the upper section 16 and moves up and down therewith.

The upper section 16 further contains an ignitor module 84. The ignitor module 84 of the upper section 16 is disposed where the top 31 of the upper section 16 meets the terminal worked side 36 of the upper section 16.

The upper section 16 further contains an ignitor switch enclosure 86. The ignitor switch enclosure 86 of the upper section 16 is disposed against the terminal worked side 36 of the upper section 16 and below, and against, the ignitor module 84 of the upper section 16.

The upper section 16 further contains an ignitor switch 88. The ignitor switch 88 of the upper section 16 is contained within the ignitor switch enclosure 86 of the upper section 16 for safety.

The upper section 16 further contains an ignitor linkage 90. The ignitor linkage 90 of the upper section 16 is affixed to the reduced portion 75 of the lower end 68 of the lower portion 64 of the fuel-feed conduit 62 of the upper section 16, and extends horizontally outwardly therefrom, in proximity to the bottom 32 of the upper section 16, to the terminal worked side 36 of the upper section 16, and then extends vertically upwardly therefrom into the ignitor switch enclosure 86 of the upper section 16 to be operatively connected to the ignitor switch 88 of the upper section 16.

The upper section 16 further contains an ignitor conduit 92. The ignitor conduit 92 of the upper section 16 extends communicatingly from the ignitor module 84 of the upper section 16, along the top 31 of the upper section 16, to, and communicates with, the upper portion 66 of the fuel-feed conduit 62 of the upper section 16 for ignition.

Specific Configuration of the Fuel Flow Controller 18

Figure 5:
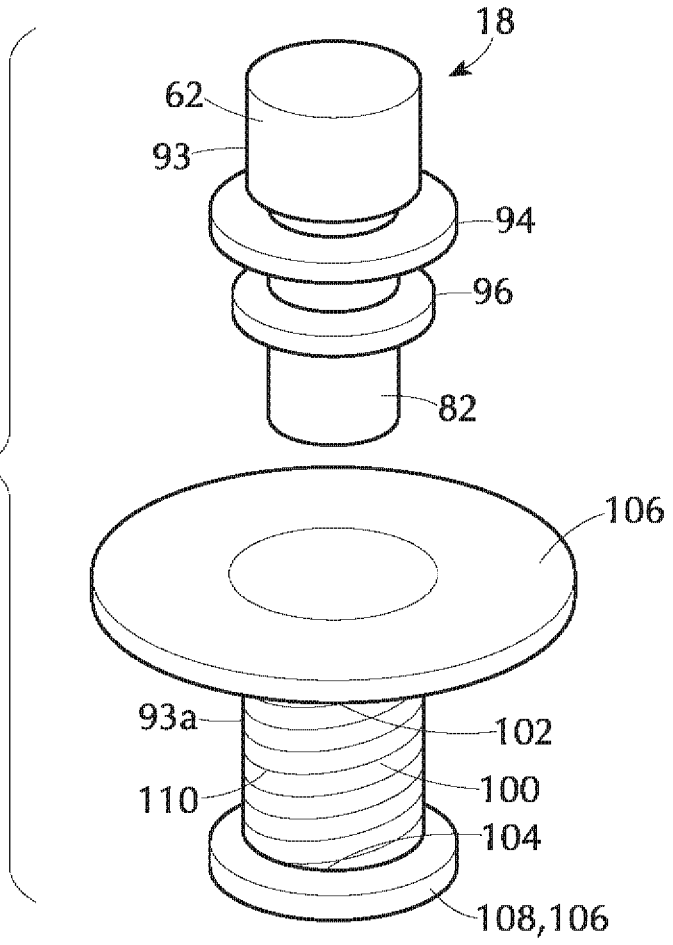
FIG. 5 is a partially exploded diagrammatic perspective view of the area generally enclosed by the dashed circle identified by ARROW 5 in FIG. 4.

The specific configuration of the fuel flow controller 18 can best be seen in FIG. 5, and as such, will be discussed with reference thereto.

The fuel flow controller 18 includes an upper valve body 93 and a lower valve body 93*a*. The lower valve body 93*a* of the fuel flow controller 18 interfaces with the lower section 14, while the upper valve body 93 of the fuel flow controller 18 interfaces with the upper section 16.

The Upper Valve Body 93 of the Fuel Flow Controller 18

The upper valve body 93 of the fuel flow controller 18 includes an upper flange 94. The upper flange 94 of the upper valve body 93 of the fuel flow controller 18 is disposed around the lower end 82 of the fuel-feed conduit 62 of the upper section 16, directly below, and attached to, the trigger linkage 78 of the upper section 16.

The upper valve body 93 of the fuel flow controller 18 further includes an O-ring 96. The O-ring 96 of the upper valve body 93 of the fuel flow controller 18 is disposed directly below the upper flange 94 of the upper valve body 93 of the fuel flow controller 18 and is for preventing leakage of the fuel 19 as the lower portion 64 of the fuel-feed conduit 62 of the upper section 16 passes vertically into the lower valve body 93*a* of the fuel flow controller 18.

The Lower Valve Body 93*a* of the Fuel Flow Controller 18

The lower valve body 93*a* of the fuel flow controller 18 is fixedly attached to the top 20 of the lower section 14.

The lower valve body 93*a* of the fuel flow controller 18 includes a tube 100. The tube 100 of the lower valve body 93*a* of the fuel flow controller 18 selectively and sealingly receives the lower end 82 of the fuel-feed conduit 62 of the upper section 16, and has an upper end 102 and a lower end 104.

The lower valve body 93*a* of the fuel flow controller 18 further includes a lower flange 106. The lower flange 106 of the lower valve body 93*a* of the fuel flow controller is disc-shaped, fixedly extends around the tube 100 of the lower valve body 93*a* of the fuel flow controller 18, and is affixed to the top 20 of the lower section 14.

The lower valve body 93*a* of the fuel flow controller 18 further includes a seal 108. The seal 108 of the lower valve body 93*a* of the fuel flow controller 18 is movably mounted to the lower end 104 of the tube 100 of the lower valve body 93*a* of the fuel flow controller 18.

The lower valve body 93*a* of the fuel flow controller 18 further includes a coil spring 110. The coil spring 110 of the lower valve body 93*a* of the fuel flow controller 18 coils around the tube 100 of the lower valve body 93*a* of the fuel flow controller 18, and normally biases the seal 108 of the lower valve body 93*a* of the fuel flow controller 18 closed.

Method of Operation of the Cigarette Lighter 10

The method of operation of the cigarette lighter 10 can best be seen in FIGS. 6A-6E, and as such, will be discussed with reference thereto.

STEP 1: Push down the trigger 44 of the upper section 16;

STEP 2: Thereby cause the trigger post 48 of the upper section 16 to move the trigger linkage 78 of the upper section 16 downwardly, against biasing of the coil spring 56 of the upper section 16;

STEP 3: Thereby cause the lower portion 64 of the fuel-feed conduit 62 of the upper section 16 to move downwardly;

STEP 4: Thereby cause the lower end 68 of the lower portion 64 of the fuel-feed conduit 62 of the upper section 16 to enter the tube 100 of the lower valve body 93*a* of the fuel flow controller 18;

STEP 5: Thereby push by the lower end 68 of the lower portion 64 of the fuel-feed conduit 62 of the upper section 16 against, and opening, the seal 108 of the lower valve body 93*a* of the fuel flow controller 18, thereby allowing the fuel 19 from the lower section 14 to flow up the fuel-feed conduit 62 of the upper section 16;

STEP 6: Thereby lift simultaneously the ignitor linkage 90 of the upper section 16;

STEP 7: Thereby cause the ignitor switch 88 of the upper section 16 to close;

STEP 8: Thereby cause the ignitor module 84 of the upper section 16 to activate;

STEP 9: Thereby cause a spark to travel through the ignitor conduit 92 of the upper section 16 to the upper end 74 of the upper portion 66 of the fuel-feed conduit 62 of the upper section 16; and STEP 10: Thereby cause the fuel 19 in the upper end 74 of the upper portion 66 of the fuel-feed conduit 62 of the upper section 16 to ignite and form the flame.

Impressions

It will be understood that each of the elements described, supra, or two or more together, may also find a useful application in other types of constructions differing from the types described, supra.

While the embodiments of the present invention have been illustrated and described as embodied in a cigarette lighter for safely moving through dangerous areas, nevertheless, they are not limited to the details shown, since it will be understood that various omissions, modifications, substitutions, and changes in the forms and details of the embodiments of the present invention illustrated and their operation can be made by those skilled in the art without departing in any way from the spirit of the embodiments of the present invention.

Without further analysis, the foregoing will so fully reveal the gist of the embodiments of the present invention that others can by applying current knowledge readily adapt them for various applications without omitting features that from the standpoint of prior art fairly constitute characteristics of the generic or specific aspects of the embodiments of the present invention.

The invention claimed is:

1. A cigarette lighter for safely moving through dangerous areas, comprising:

a) a lower section;

b) an upper section; and c) a fuel flow controller;

wherein said upper section is replaceably attached to said lower section;

wherein said fuel flow controller interfaces with said lower portion and said upper portion;

wherein said fuel flow controller controls a flow of a fuel from said lower section where stored to said upper section where ignited;

wherein said lower section contains a reservoir for storing the fuel therein;

wherein said lower section has a spring-loaded ball-release; and wherein said spring-loaded ball-release of said lower section is biased outwardly;

wherein said spring-loaded ball-release of said lower section is disposed on said axial male flange of said top of said lower section;

wherein said upper section is generally rectangular-shaped; and wherein said upper section is hollow.

2. The cigarette lighter of claim 1, wherein said lower section is generally rectangular-shaped;

wherein said lower section is generally hollow; and wherein said lower section has a top.

3. The cigarette lighter of claim 2, wherein said lower section has a side;

wherein said top of said lower section is open to communicate with said upper section; and wherein said top of said lower section holds said fuel flow controller in position.

4. The cigarette lighter of claim 3, wherein said top of said lower section is reduced laterally;

wherein said top of said lower section forms an axial male flange therearound; and wherein said lower section is a replaceable canister.

5. The cigarette lighter of claim 4, wherein said upper section has a top;

wherein said upper section has a bottom; and wherein said upper section has an initial working side.

6. The cigarette lighter of claim 5, wherein said upper section has a terminal worked side;

wherein said upper section has a corner; and wherein said corner is disposed where said initial working side of said upper section meets said top of said upper section.

7. The cigarette lighter of claim 6, wherein said corner of said upper section is removed, leaving a portion of said initial working side of said upper section in tact;

wherein said portion of said initial working side of said upper section has a through bore therethrough; and wherein said bottom of said upper section is open.

8. The cigarette lighter of claim 5, wherein said bottom of said upper section communicates with said lower section;

wherein said bottom of said upper section selectively receives said axial male flange of said lower section; and wherein said bottom of said upper section frictionally receives said axial male flange of said lower section.

9. The cigarette lighter of claim 7, wherein said through bore of said portion of said initial working side of said upper section selectively receives said spring-loaded ball-release of said lower section;

wherein said spring-loaded ball-release of said lower section is pushed in and out of said through bore of said portion of said initial working side of said upper section preventing spontaneous separation and said upper section is pulled up and off, thereby removing said upper section from said lower section and discarding said lower section so that said upper portion can be moved safely through the dangerous areas; and wherein said upper section has a trigger.

10. The cigarette lighter of claim 9, wherein said trigger of said upper section is movably mounted in said corner of said upper section;

wherein said upper section contains scaffolding; and wherein said scaffolding of said upper section is fixedly attached within said upper section.

11. The cigarette lighter of claim 10, wherein said scaffolding of said upper section is fixedly attached to said upper section;

wherein said scaffolding of said upper section is generally L-shaped; and wherein said scaffolding of said upper section extends downwardly from the top of the upper section in a vertical portion.

12. The cigarette lighter of claim 10, wherein said scaffolding of said upper section extends laterally to the corner of the upper section in an horizontal portion;

wherein said upper section contains a trigger post; and wherein said trigger post of said upper section is vertically oriented.

13. The cigarette lighter of claim 12, wherein said trigger post of said upper section moves vertically through said horizontal portion of said scaffolding of said upper section;

wherein said trigger post has an upper end; and wherein said trigger post has a lower end.

14. The cigarette lighter of claim 13, wherein said upper section contains a trigger connecting rod;

wherein said trigger connecting rod of said upper section is horizontally oriented; and wherein said trigger connecting rod of said upper section extends fixedly from said upper end of said trigger post of said upper section.

15. The cigarette lighter of claim 14, wherein said trigger connecting rod of said upper section moves with said upper end of said trigger post of said upper section;

wherein said trigger connecting rod of said upper section extends to said trigger of said upper section; and wherein said trigger connecting rod of said upper section moves with said trigger of said upper section.

16. The cigarette lighter of claim 14, wherein said upper section contains a coil spring;

wherein said coil spring of said upper section coils around an upper portion of said trigger post of said upper section; and wherein said upper portion of said trigger post of said upper section extends from said trigger connecting rod of said upper section.

17. The cigarette lighter of claim 16, wherein said upper portion of said trigger post of said upper section extends to a spring seat of said horizontal portion of said scaffolding of said upper section;

wherein said coil spring of said upper section normally bias said trigger of said upper section upward via said trigger connecting rod of said upper section; and wherein said coil spring of said upper section compresses as said trigger post of said upper section moves downwardly when said trigger of said upper section is pressed downwardly, and said coil spring of said upper section biases said trigger back upwardly when pressure is removed from said trigger of said upper section.

18. The cigarette lighter of claim 15, wherein said upper section contains a fuel-feed conduit;

wherein said fuel-feed conduit of said upper section is vertically oriented; and wherein said fuel-feed conduit of said upper section is hollow.

19. The cigarette lighter of claim 18, wherein said fuel-feed conduit of said upper section is disposed parallel to said initial working side of said upper portion;

wherein said fuel-feed conduit of said upper section is inwardly of said initial working side of said upper portion; and wherein said fuel-feed conduit of said upper section includes a lower portion.

20. The cigarette lighter of claim 19, wherein said fuel-feed conduit of said upper section includes an upper portion;

wherein said lower portion of said fuel-feed conduit of said upper section has a lower end; and wherein said lower portion of said fuel-feed conduit of said upper section has an upper end.

21. The cigarette lighter of claim 20, wherein said upper portion of said fuel-feed conduit of said upper section has a lower end;

wherein said lower end of said lower portion of said fuel-feed conduit of said upper section has a reduced portion; and wherein said upper portion of said fuel-feed conduit of said upper section has an upper end.

22. The cigarette lighter of claim 21, wherein said upper end of said upper portion of said fuel-feed conduit of said upper section is vertically affixed to said top of said upper section;

wherein said upper end of said upper portion of said fuel-feed conduit of said upper section is accessible via said top of said upper section; and wherein said lower end of said upper portion of said fuel-feed conduit of said upper section is open.

23. The cigarette lighter of claim 21, wherein said upper end of said upper portion of said fuel-feed conduit of said upper section is open;

wherein said lower end of said upper portion of said fuel-feed conduit of said upper section telescopically receives said upper end of said lower portion of said fuel-feed conduit of said upper section so as to allow said lower portion of said fuel-feed conduit of said upper section to slide up and down in said upper portion of said fuel-feed conduit of said upper section; and wherein said upper end of said upper portion of said fuel-feed conduit of said upper section is an output hole for a flame for igniting a cigarette.

24. The cigarette lighter of claim 21, wherein said upper section contains a trigger linkage;

wherein said trigger linkage of said upper section is generally horizontally oriented; and wherein said trigger linkage of said upper section has an initial working end.

25. The cigarette lighter of claim 24, wherein said trigger linkage of said upper section has a terminal worked end;

wherein said initial working end of said trigger linkage of said upper section is affixed to said trigger of said upper section; and wherein said initial working end of said trigger linkage of said upper section depends from said trigger of said upper section.

26. The cigarette lighter of claim 24, wherein said initial working end of said trigger linkage of said upper section moves up and down with said trigger of said upper section;

wherein said trigger linkage of said upper section extends continuously from said initial working end of said trigger linkage of said upper section; and wherein said trigger linkage of said upper section is affixed to said lower end of said trigger post of said upper section.

27. The cigarette lighter of claim 24, wherein said trigger linkage of said upper section moves up and down with said lower end of said trigger post of said upper section;

wherein said trigger linkage of said upper section extends continuously from said lower end of said trigger post of said upper section; and wherein said trigger linkage of said upper section is affixed to said lower end of said lower portion of said fuel-feed conduit of said upper section as said terminal worked end of said trigger linkage of said upper section.

28. The cigarette lighter of claim 24, wherein said trigger linkage of said upper section moves up and down with said lower end of said fuel-feed conduit of said upper section as said terminal worked end of said trigger linkage of said upper section;

wherein said trigger linkage of said upper section extends continuously from said lower end of said trigger post of said upper section; and wherein said terminal worked end of said trigger linkage of said upper section is affixed in said reduced portion of said lower end of said lower portion of said fuel-feed conduit of said upper section.

29. The cigarette lighter of claim 24, wherein said terminal worked end of said trigger linkage of said upper section moves up and down with said reduced portion of said lower end of said fuel-feed conduit of said upper section;

wherein said upper section contains an ignitor module; and wherein said ignitor module of said upper section is disposed where said top of said upper section meets said terminal worked side of said upper section.

30. The cigarette lighter of claim 29, wherein said upper section contains an ignitor switch enclosure;

wherein said ignitor switch enclosure of said upper section is disposed against said terminal worked side of said upper section; and wherein said ignitor switch enclosure of said upper section is disposed below said ignitor module of said upper section.

31. The cigarette lighter of claim 30, wherein said ignitor switch enclosure of said upper section is disposed against said ignitor module of said upper section;

wherein said upper section contains an ignitor switch; and wherein said ignitor switch of said upper section is contained within said ignitor switch enclosure of said upper section for safety.

32. The cigarette lighter of claim 31, wherein said upper section contains an ignitor linkage;

wherein said ignitor linkage of said upper section is affixed in said reduced portion of said lower end of said lower portion of said fuel-feed conduit of said upper section; and wherein said ignitor linkage of said upper section extends horizontally outwardly from said reduced portion of said lower end of said lower portion of said fuel-feed conduit of said upper section.

33. The cigarette lighter of claim 32, wherein said ignitor linkage of said upper section is affixed in the reduced portion of said lower end of said lower portion of said fuel-feed conduit of said upper section and extends in proximity to said bottom of said upper section;

wherein said ignitor linkage of said upper section extends to said terminal worked side of said upper section; and wherein said ignitor linkage of said upper section extends vertically upwardly into said ignitor switch enclosure of said upper section.

34. The cigarette lighter of claim 32, wherein said ignitor linkage of said upper section is operatively connected to said ignitor switch of said upper section;

wherein said upper section contains an ignitor conduit; and wherein said ignitor conduit of said upper section extends communicatingly from said ignitor module of said upper section.

35. The cigarette lighter of claim 34, wherein said ignitor conduit of said upper section extends along said top of said upper section;

wherein said ignitor conduit of said upper section extends to said upper portion of said fuel-feed conduit of said upper section for ignition; and wherein said ignitor conduit of said upper section communicates with said upper portion of said fuel-feed conduit of said upper section for ignition.

36. The cigarette lighter of claim 24, wherein said fuel flow controller includes an upper valve body;

wherein said fuel flow controller includes a lower valve body; and wherein said lower valve body of said fuel flow controller interfaces with said lower section.

37. The cigarette lighter of claim 36, wherein said upper valve body of said fuel flow controller interfaces with said upper section;

wherein said upper valve body of said fuel flow controller includes an upper flange; and wherein said upper flange of said upper valve body of said fuel flow controller is disposed around said upper valve body of said fuel-feed conduit of said upper section.

38. The cigarette lighter of claim 37, wherein said upper flange of said upper valve body of said fuel flow controller is disposed directly below said trigger linkage of said upper section;

wherein said upper flange of said upper valve body of said fuel flow controller is attached to said trigger linkage of said upper section; and wherein said upper valve body of said fuel flow controller includes an O-ring for preventing leakage of the fuel as said lower portion of said fuel-feed conduit of said upper section passes vertically into said lower valve body of said fuel flow controller.

39. The cigarette lighter of claim 38, wherein said O-ring of said upper valve body of said fuel flow controller is disposed directly below said upper flange of said upper valve body of said fuel flow controller;

wherein said lower valve body of said fuel flow controller is fixedly attached to said top of said lower section; and wherein said lower valve body of said fuel flow controller includes a tube.

40. The cigarette lighter of claim 39, wherein said tube of said lower valve body of said fuel flow controller selectively receives said lower end of said lower portion of said fuel-feed conduit of said upper section;

wherein said tube of said lower valve body of said fuel flow controller sealingly receives said lower end of said lower portion of said fuel-feed conduit of said upper section; and wherein said tube of said lower valve body of said fuel flow controller has an upper end.

41. The cigarette lighter of claim 39, wherein said tube of said lower valve body of said fuel flow controller has a lower end;

wherein said lower valve body of said fuel flow controller includes a lower flange; and wherein said lower flange of said lower valve body of said fuel flow controller is disc-shaped.

42. The cigarette lighter of claim 41, wherein said lower flange of said lower valve body of said fuel flow controller fixedly extends around said tube of said lower valve body of said fuel flow controller;

wherein said lower flange of said lower valve body of said fuel flow controller is affixed to said top of said lower section; and wherein said lower valve body of said fuel flow controller includes a seal.

43. The cigarette lighter of claim 42, wherein said seal of said lower valve body of said fuel flow controller is movably mounted to said lower end of said tube of said lower valve body of said fuel flow controller;

wherein said lower valve body of said fuel flow controller includes a coil spring;

wherein said coil spring of said lower valve body of said fuel flow controller coils around said tube of said lower valve body of said fuel flow controller; and wherein said coil spring of said lower valve body of said fuel flow controller normally biases said seal of said lower valve body of said fuel flow controller closed.

* * * * *